US007379697B2

(12) United States Patent
Ito et al.

(10) Patent No.: US 7,379,697 B2
(45) Date of Patent: May 27, 2008

(54) IMAGE HEATING APPARATUS WITH A PAD SHEET FOR A PRESSING MEMBER OF THE IMAGE HEATING APPARATUS

(75) Inventors: Yoshikuni Ito, Tokyo (JP); Isao Kumada, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 255 days.

(21) Appl. No.: 11/252,732

(22) Filed: Oct. 19, 2005

(65) Prior Publication Data

US 2006/0083567 A1 Apr. 20, 2006

(30) Foreign Application Priority Data

Oct. 20, 2004 (JP) ..... 2004-305515

(51) Int. Cl.
*G03G 15/20* (2006.01)

(52) U.S. Cl. ..... 399/329

(58) Field of Classification Search ..... 399/329
See application file for complete search history.

(56) References Cited

U.S. PATENT DOCUMENTS

| | | | | |
|---|---|---|---|---|
| 3,784,297 | A | 1/1974 | Ito et al. | 355/3 |
| 3,945,726 | A | 3/1976 | Ito et al. | 355/3 R |
| 5,666,624 | A | 9/1997 | Kanesawa et al. | 399/329 |
| 6,895,208 | B2 | 5/2005 | Nakatogawa et al. | 399/329 |
| 7,171,150 | B2 | 1/2007 | Yonekawa | 399/329 |
| 2004/0057759 | A1* | 3/2004 | Ogiso et al. | 399/329 |
| 2004/0131401 | A1 | 7/2004 | Nakatogawa et al. | 399/328 |
| 2006/0083567 | A1 | 4/2006 | Ito et al. | 399/400 |
| 2006/0216077 | A1* | 9/2006 | Komuro | 399/328 |

FOREIGN PATENT DOCUMENTS

| | | |
|---|---|---|
| JP | 9-34291 | 2/1997 |
| JP | 2002-148970 | 5/2002 |
| JP | 2003-107936 | 4/2003 |
| JP | 2004-206105 | 7/2004 |
| JP | 2004-286932 | 10/2004 |

OTHER PUBLICATIONS

English-language translation of Chinese Office Action issued Jan. 18, 2008, in Chinese Application No. 200510116431.5.

* cited by examiner

*Primary Examiner*—David M. Gray
*Assistant Examiner*—Ryan D. Walsh
(74) *Attorney, Agent, or Firm*—Fitzpatrick, Cella, Harper & Scinto

(57) ABSTRACT

An image heating apparatus includes a heating rotatable member for heating an image on a recording material in a heating nip; a belt for cooperating with the heating rotatable member to form a heating nip; a pad for urging the belt toward the heating rotatable member at the heating nip; and a sheet covering a surface of the pad opposed to the heating rotatable member, the sheet being slidable on the belt, wherein includes a surface layer having a low friction property and a base layer having a tensile strength of 300-600 MPa.

9 Claims, 11 Drawing Sheets

IMAGE HEATING APPARATUS WITH A PAD SHEET FOR A PRESSING MEMBER OF THE IMAGE HEATING APPARATUS

FIELD OF THE INVENTION AND RELATED ART

The present invention relates to an image heating apparatus for heating the image on recording medium, and the pad sheet for such an image heating apparatus. As examples of such an image heating apparatus, it is possible to list a fixing apparatus for fixing an unfixed image formed on recording medium, a glossiness increasing apparatus for increasing the glossiness of a fixed image on recording medium, by heating the fixed image, etc. Such an image heating apparatus can be employed by an electrophotographic copying machine, an electro-photographic printer, an electrophotographic facsimileing machine, etc.

As described above, an electrophotographic image forming apparatus such as the abovementioned electrophotographic copying machine, electrophotographic printer, an electrophotographic facsimileing machine, or the like employs a fixing apparatus for thermally fixing an unfixed image formed of toner. As such a fixing apparatus, various fixing apparatuses different in heating method have been proposed, and some of them have been manufactured as commercially viable products. As for the type of a heating method employed by such a fixing apparatus, there is a belt nip method, for example, according to which a fixation belt is kept pressed upon a fixation roller having a heat source, by a pressure applying member.

As an example of a fixing apparatus of this belt nip type, Japanese Laid-open Patent 9-34291 discloses one. This fixing apparatus is provided with: a fixation roller for heating (which hereinafter will be referred to as thermal fixation roller); a belt which forms a fixation nip between itself and the thermal fixation roller; and a pressure pad for keeping the belt toward the thermal fixation roller.

The pressure pad of a fixing apparatus of the abovementioned type is formed of rubber or the like substance. Therefore, the friction between the belt and pressure pad is substantial, causing such problems as the positional deviation of recording medium relative to the image thereon, recording medium conveyance errors, etc.

Thus, Japanese Laid-open Patent Application 2004-206105 discloses a fixing apparatus, the pressure pad of which is covered with a sheet of substance substantially smaller in friction than the material (rubber) for the pressure pad proper, across the surface facing the abovementioned belt.

This sheet (which hereinafter will be referred to as pad sheet) is made up of a substrate layer, and two layers of nonporous sheets which sandwich the substrate. The substrate layer is a piece of cloth woven of glass fiber coated with fluorinated resin, and the two nonporous sheets are formed of PTFE.

Further, it has been proposed to coat the inward surface of the belt, in terms of the loop the belt forms, with lubricant such as silicon oil, and a few fixing apparatuses structured for coating the inward surface of the belt with lubricant have been put to practical use.

Japanese Laid-open Patent Applications 2002-148970 and 2003-107936 disclose fixing apparatuses characterized not only in that the pressure pad is provided with the aforementioned pad sheet which is substantially smaller in the friction than the pressure pad itself, but also, that the pad sheet is given knurls of a substantial size, across the surface facing the belt. Further, a few fixing apparatuses such as those disclosed in the abovementioned patent applications have been put to practical use.

Knurling the above described pad sheet, that is, a low friction sheet, on the pressure pad, across the surface which faces the belt, can reduce the number of the points of contact between the pad sheet and the inward surface of the belt, reducing thereby the overall friction between the pad sheet and the inward surface of the belt.

As for the case in which not only is the pad sheet is knurled as described above, but also, the inward surface of the belt is coated with lubricant such as oil, the intervals among the knurls on the surface of the pad sheet are effective to hold the lubricant such as oil, contributing to further reducing the friction between the pad sheet and the inward surface of the belt.

However, the above described prior arts possibly cause the following problems.

That is, in the case of a fixing apparatus employing a fixing method of the above described belt nip type, the inward surface of the endless belt slides on the pressure applying member during fixation. As it slides, the top layer, that is, the fluorinated resin (PFA) film, of the pad sheet gradually wears by friction. With the progression of the frictional wear of the fluorinated film, the film stretches. As a result, the endless belt becomes unstable in rotation. In other words, the fixing apparatus of this type is unsatisfactory in terms of durability.

As described above, in the case of a fixing apparatus in accordance with any of the above described prior arts, as the cumulative amount of the apparatus usage increases, the friction between the pad sheet and fixation belt gradually increases, eventually causing the speed of the fixation belt to become different from the peripheral velocity of the thermal fixation roller. Therefore, such problems arises that a sheet of recording medium conveyed by the fixation belt deviates in its positional relationship to the image thereon; the sheet of recording medium is erroneously conveyed; etc. This is because the speed at which a sheet of recording medium is conveyed for image fixation is dependent upon the speed of the fixation belt.

On the other hand, compared to the above described pad sheet made of a piece of cloth woven of glass fiber coated with fluorinated resin (PFA), it is superior in wear resistance. However, it is greater in frictional resistance, possibly creating the above described problems attributable to the load increase resulting from the greater frictional resistance.

Also, it is possible that as the peripheral velocity of the fixation belt is switched from the high speed to the low speed, shuddering occur because of the larger friction, making the fixation belt unstable in rotational motion. The shuddering is likely to occur when the ambience is high in temperature and humidity.

SUMMARY OF THE INVENTION

The primary object of the present invention is to provide an image heating apparatus superior to an image heating apparatus in accordance with the prior art, in terms of the durability of the pad sheet against which the fixation belt slides, and also, to provide a pad sheet employable by an image heating apparatus to achieve the above described object.

According to an aspect of the present invention, there is provided an image heating apparatus comprising a heating rotatable member for heating an image on a recording material in a heating nip; a belt for cooperating with the heating rotatable member to form a heating nip; a pad for urging the belt toward the heating rotatable member at the heating nip; and a sheet covering a surface of the pad opposed to the heating rotatable member, the sheet being slidable on the belt, wherein includes a surface layer having a low friction property and a base layer having a tensile strength of 300-600 MPa.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described in detail with reference to the appended drawings. Incidentally, the measurements, materials, and shapes of the structural components, and their positional relationship, etc., in the following embodiments of the present invention, are to be altered as necessary according to the structure of an apparatus to which the present invention is applied, and various conditions under which the present invention is applied. In other words, the following embodiments of the present invention are not intended to limit the scope of the present invention.

An image heating apparatus in accordance with the present invention can be used as a fixing apparatus for fixing an unfixed image formed on recording medium, or a glossiness increasing apparatus for increasing in glossiness a fixed image on recording medium by heating the fixed image. This image heating apparatus can be employed by an image forming apparatus such as a copying machine, a printer, a facsimileing machine, etc., which uses one of the electrophotographic image forming methods.

The following embodiments of the present invention will be described with reference to a fixing apparatus.

The present invention is intended to keep at a low level, the friction between the fixation belt of a fixing apparatus, and the pad sheet which covers the pressure applying member of the fixing apparatus, by improving the pad sheet in durability.

Further, it is intended to prevent the phenomenon that as the peripheral velocity of a fixation belt is switched from a high speed to a lower speed, the fixation belt and sheet momentarily stick to each other; in other words, they stick and slide relative to each other.

First, an image forming apparatus 100, that is, a typical image forming apparatus, to which the present invention is applicable, will be described referring to FIG. 16, which is a schematic sectional view of the image forming apparatus 100.

Figure 16:
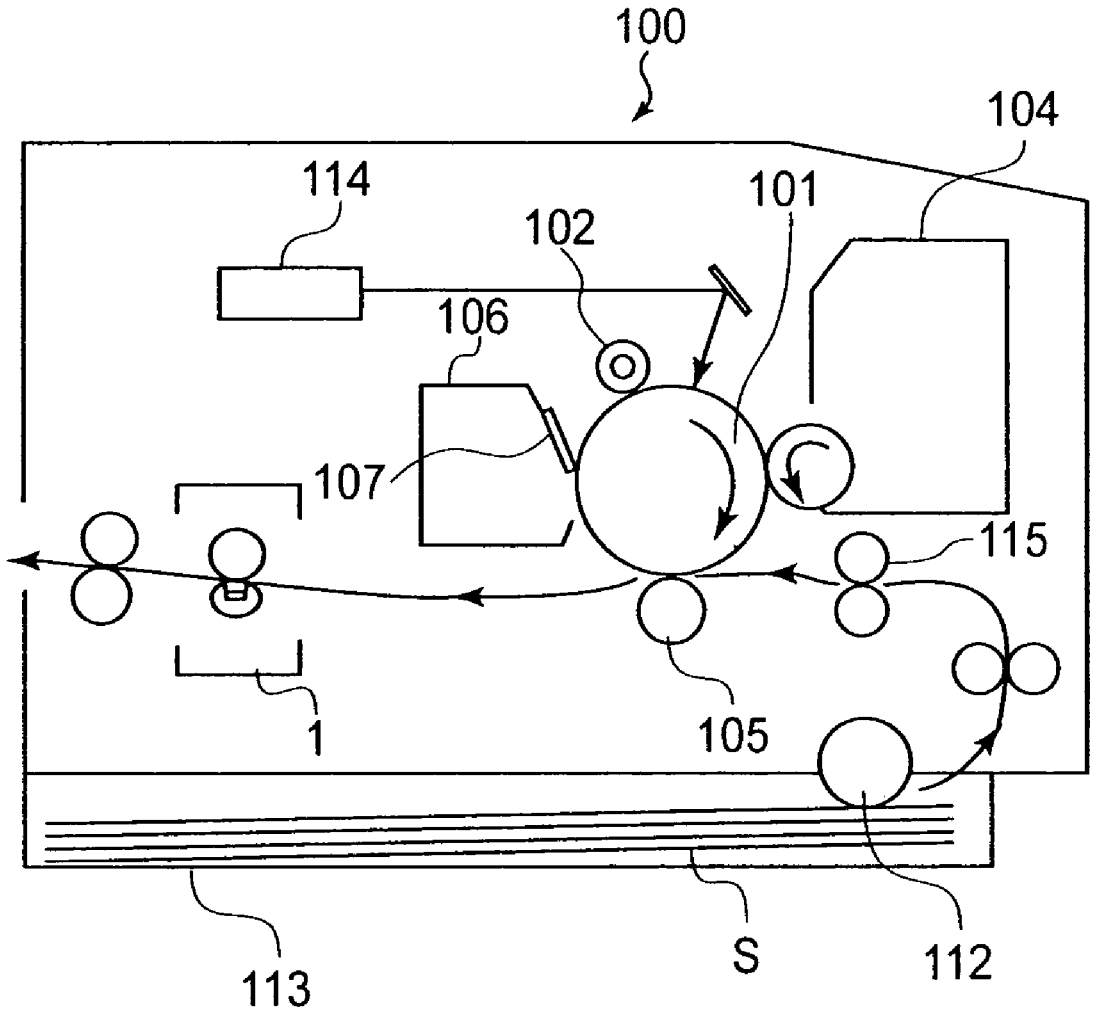
FIG. 16 is a schematic sectional view of a typical image forming apparatus.

The image forming apparatus shown in FIG. 16 is provided with an electrophotographic photosensitive member 101, as an image bearing member, which is in the form of a drum (which hereinafter will be referred to simply as photosensitive drum). The photosensitive drum 101 is rotationally driven by the driving force transmitted thereto, so that it rotates about its rotational axis at a predetermined process speed (peripheral velocity).

The photosensitive drum 101 is charged across its peripheral surface, by a charge roller 102 as a charging apparatus. The charge roller 102 is disposed in contact with the peripheral surface of the photosensitive drum 101, being thereby rotated by the rotation of the photosensitive drum 101. To the charge roller 102, charge bias is applied by a charge bias application power source (unshown). The charge bias is the combination of AC and DC voltages, for example. As the charge bias is applied to the charge roller 102, the peripheral surface of the photosensitive drum 101 is uniformly charged to predetermined polarity and potential level.

After the charging of the peripheral surface of the photosensitive drum 101, an electrostatic latent image is formed on the peripheral surface of the photosensitive drum 101 by an exposing apparatus 114, which is an apparatus for projecting a beam of laser light upon the peripheral surface of the photosensitive drum 101, while modulating the beam with image formation data, to form an electrostatic latent image on the peripheral surface of the photosensitive drum 101.

The electrostatic latent image formed on the peripheral surface of the photosensitive drum 101 though the above described process is developer into an image formed of toner (which hereinafter will be referred to simply as toner image), by a developing apparatus 104; toner as developer is adhered to the electrostatic latent image.

The toner image effected on the peripheral surface of the photosensitive drum 101 is transferred onto a recording medium S, that is, a sheet of recording medium, by a transfer roller 105 as a transferring apparatus. The recording medium S is stored in a sheet feeder cassette 113 along with the other sheets of recording medium. It is fed from the sheet feeder cassette 113 into the main assembly of the image forming apparatus, by a feed roller 112, and then, is delivered by a pair of registration rollers 115, etc., in the direction indicated by an arrow mark, to the transfer nip, in synchronism with the arrival of the toner image on the peripheral surface of the photosensitive drum 101 at the transfer nip. To the transfer roller 105, transfer bias, which is opposite in polarity to the toner image on the peripheral surface of the photosensitive drum 101, is applied by a transfer bias application power source (unshown). As a result, the toner image on the peripheral surface of the photosensitive drum 101 is transferred onto the recording medium S.

The toner remaining on the peripheral surface of the photosensitive drum 101 after the transfer of the toner image onto the recording medium S is removed by the cleaning blade of a cleaning apparatus 106, so that the peripheral surface of the photosensitive drum 101 can be used for the next cycle of image formation.

After the transfer of the toner image onto the recording medium S, the recording medium S is conveyed to a fixing apparatus 1. In the fixing apparatus 1, the recording medium S and the toner image thereon are subject to heat and pressure. As a result, the toner image on the recording medium S is fixed to the recording medium S. After the fixation of the toner image, the recording medium S is discharged from the image forming apparatus 100, ending the formation of a single copy of an intended image.

Next, the fixing apparatus 1 in accordance with the present invention will be described.

Figure 9:
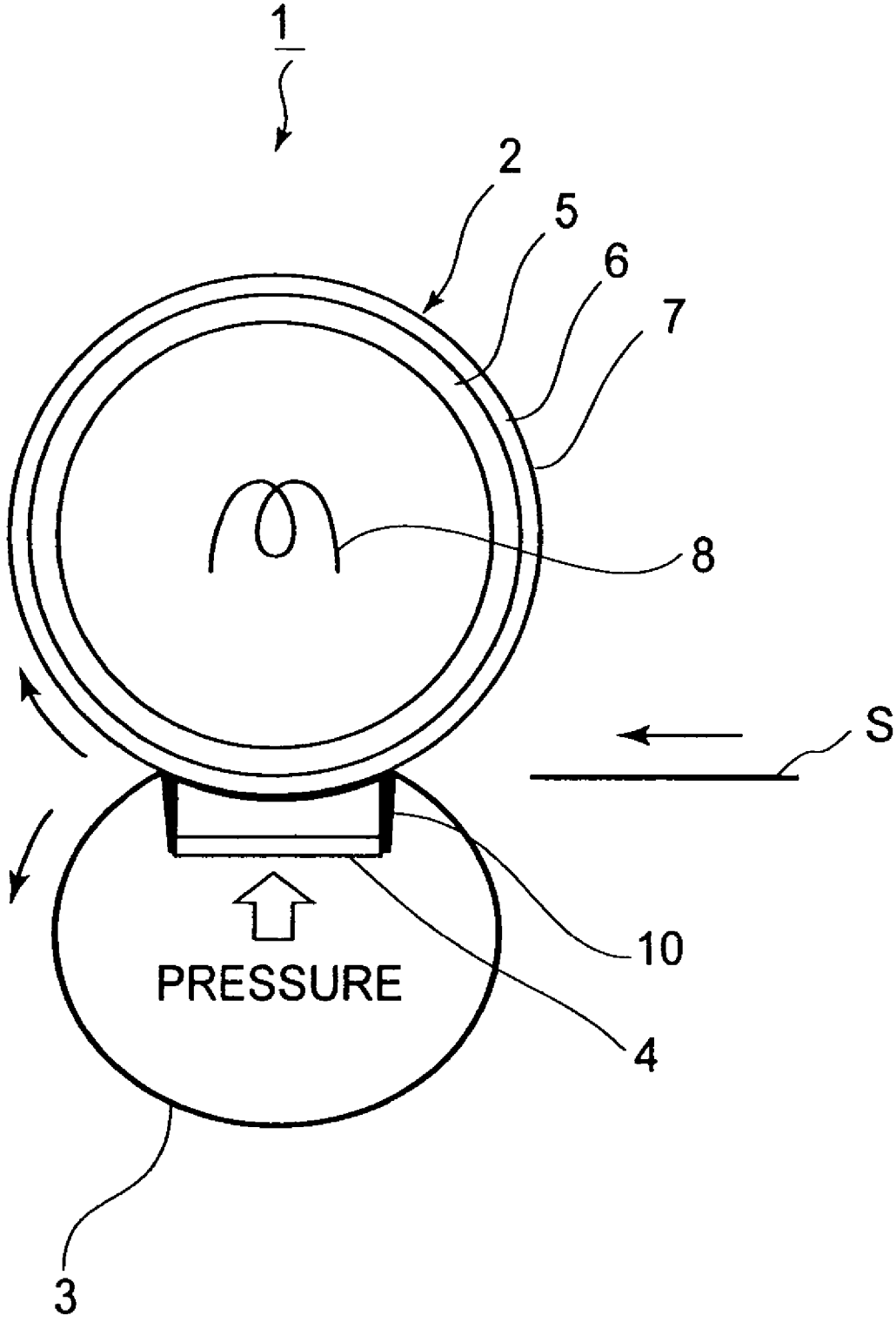
FIG. 9 is a schematic sectional view of a typical fixing apparatus.

FIG. 9 is a schematic sectional view of the fixing apparatus 1 in accordance with the present invention, showing the general structure thereof.

This fixing apparatus 1 is provided with a thermal fixation roller 2, which is a rotatable heating member (rotatable image fixing member) containing a heat source. The fixing apparatus 1 is also provided with an endless belt 3 and a belt pressing pad 4. The endless belt 3 is disposed pressed upon the thermal fixation heat roller 2. The belt pressing pad 4 is an elastic member (pressure applying member), and is kept pressed on the endless belt 3, across the inward surface of the endless belt 3, keeping thereby the endless belt 3 pressed upon the peripheral surface of the thermal fixation roller 2.

With the endless belt 3 pressed upon the thermal fixation roller 2, a nip (fixation nip) is formed between the endless belt 3 and thermal fixation roller 2. The recording medium bearing the unfixed toner image is conveyed through this fixation nip, while remaining pinched between the thermal fixation roller 2 and endless belt 3. As the recording medium is conveyed through the fixation nip, the unfixed toner image is fixed to the recording medium.

Referring again to FIG. 9, the fixing apparatus 1 is structured so that the thermal fixation roller 2 is rotationally driven by an unshown driving force source, in the direction indicated by an arrow mark at a predetermined speed, for example, a peripheral velocity of 200 mm/sec.

The thermal fixation roller 2 has a cylindrical metallic core 5, which is 60 mm in external diameter, 57 mm in internal diameter, and 350 mm in length, for example. As for the material for the metallic core 5, aluminum, stainless steel, or the like, is used. The peripheral surface of the metallic core 5 is coated with a 2 mm thick elastic layer 6 formed of HTV silicone rubber (10 degrees in JIS-A hardness scale for rubber). Further, the outward surface of the elastic layer 6 is covered with a 50 μm thick tube, as a surface layer 7, formed of a fluorinated substance. The outward surface of the surface layer 7 is polished to a mirror-like condition.

As the material for the metallic core 5, a metallic substance, other than aluminum, stainless, or the like, which is high in thermal conductivity, may be used. Further, instead of using the abovementioned tube as the surface layer 7, the elastic layer 6 may be coated with fluorinated resin.

The metallic core 5 is hollow, and a 1,000 W halogen lamp 8 as heat source is disposed in the hollow of the metallic core 5. The thermal fixation roller 2 is heated from therein by the halogen lamp 8 so that its surface temperature remains at a predetermined level. The surface temperature of the thermal fixation roller 2 is detected by a temperature sensor of the contact or noncontact type, which is disposed in contact, or with no contact, respectively, with the peripheral surface of the thermal fixation roller 2. More specifically, the amount by which electric power is supplied to the halogen lamp 8 is controlled by a temperature controller in response to the temperature level detected by the temperature sensor, so that the surface temperature of the thermal fixation roller 2 remains at 170° C., for example.

The abovementioned endless belt 3 is heat resistant, and is kept pressed upon the peripheral surface of the thermal fixation roller 2 so that a nip with a predetermined width is formed between the peripheral surface of the thermal fixation roller 2 and endless belt 3. The endless belt 3 is formed of polyimide film, and is 75 m in thickness, 340 mm in width, and 150 mm in circumference, for example. It is covered with a tube formed of fluorinated resin such as PFA, as a surface layer.

The endless belt 3 is kept pressed on the thermal fixation roller 2 by the belt pressing pad 4 from the inward side of the loop which the belt 3 forms. It is rotated by the rotation of the thermal fixation roller 2. Some endless belts are provided with a 200 μm thick rubber layer, which is placed between the surface layer (tube) and substrate layer (polyimide). These endless tubes are better choices for some color image forming apparatuses.

Figure 10:
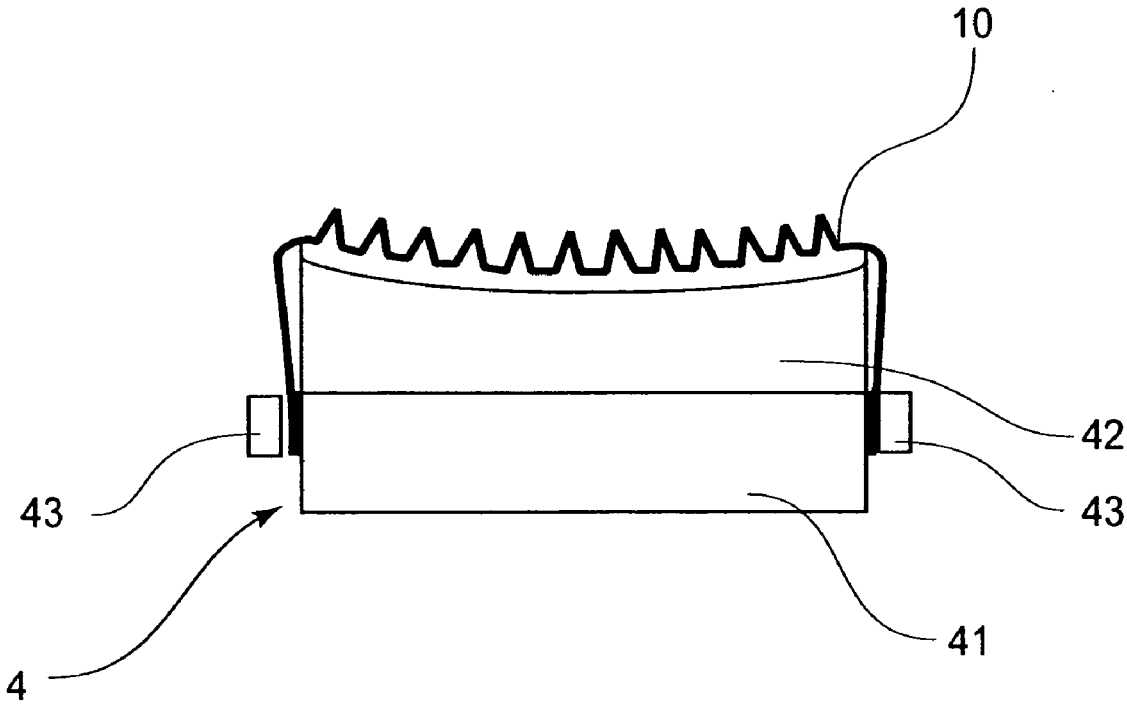
FIG. 10 is a drawing for describing the structure of the elastic member.

Referring to FIG. 10, the belt pressing pad 4 is made up of a base plate 41, which is formed of a metallic substance such as stainless steel, and an elastic layer 42 laminated on the surface of the base plate 41. The belt pressing pad 4 is also provided with a pad sheet 10, which covers the belt pressing pad 4, across the surface facing the thermal fixation roller 2. In other words, the pad sheet 10 is provided to prevent the problem that the belt pressing pad 4 is worn by the friction between the pad 4 and endless belt 3 as the belt 3 is circularly driven.

Further, the belt pressing pad 4 is kept pressed toward the thermal fixation roller 2 by compression springs as pressure applying members, which are disposed on the spring mounts as supporting members located on the base plate side. The amount of the pressure generated by the compression springs is 50 kgf (50×9.8 N). As for the material and size of the base plate 41, the base plate 41 is formed of stainless steel, and is 20 mm in length (in terms of direction in which endless belt 3 is driven), 360 mm in width (direction parallel to axial direction of thermal fixation roller 2), and 5 mm in thickness, for example.

The elastic layer 42 is formed of silicone rubber with a hardness of 20 degrees. As for the thickness of the elastic layer 42, it is 5 mm at the center of the nip, in terms of the direction in which the endless belt 3 is circularly driven, and increases on the upstream and downstream side, with the distance from the center of the nip, in terms of the direction in which the belt 3 is driven, since the distance between the thermal fixation roller 2 and the belt pressing pad 4 increases on the upstream and downstream side, with the distance from the center of the nip, due to the curvature of the peripheral surface of the roller 2.

The abovementioned hardness (20 degrees) of the elastic layer 42 was obtained with the use of a sponge rubber hardness meter of Asker C scale type (product of Kabushiki Kagaku Co., Ltd.) while applying a load of 300 gf (300×9.8 mN).

In this embodiment, in order to reduce the friction between the belt pressing pad 4 and endless belt 3, the pad 4 is provided with a pad sheet 10, which covers the pad 4. The pad sheet 10 is made up of a surface layer, which is low in friction, and a substrate layer, the tensile strength of which is in a range of 300-600 MPa.

The surface layer is desired to be heat resistant and wear resistant. The substrate layer is desired to be heat resistant enough to prevent the surface layer from deforming.

The present invention is characterized by the characteristics of this pad sheet 10. The following Table 1 shows the laminar structures of test samples of the pad sheet 10 in accordance with the present invention, and the laminar structures of comparative pad sheets. It also shows whether the pad sheets were smooth or knurled across the outward surface.

TABLE 1

| | layer structure | knurling |
|---|---|---|
| Exp. 1 | fluorinate resin + PI | No |
| Exp. 2 | fluorinate resin + rubber layer + PI | No |
| Exp. 3 | fluorinate resin + PI | Yes |
| Exp. 4 | fluorinate resin + rubber layer + PI | Yes |
| Comp. 1 | PI single layer | No |
| Comp. 2 | PI single layer | Yes |
| Comp. 3 | single layer of fluorinate resin | No |
| Comp. 4 | single layer of fluorinate resin | Yes |

Next, the test samples 1-4 of the pad sheet 10 in accordance with the present invention, and comparative samples 1-4, will be described in detail.

Figure 1:
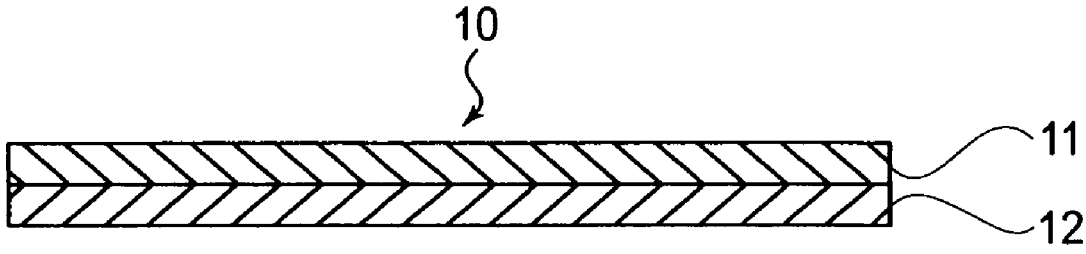
FIG. 1 is a drawing for describing the structure of the first test sample of a pad sheet in accordance with the present invention.
Figure 2:
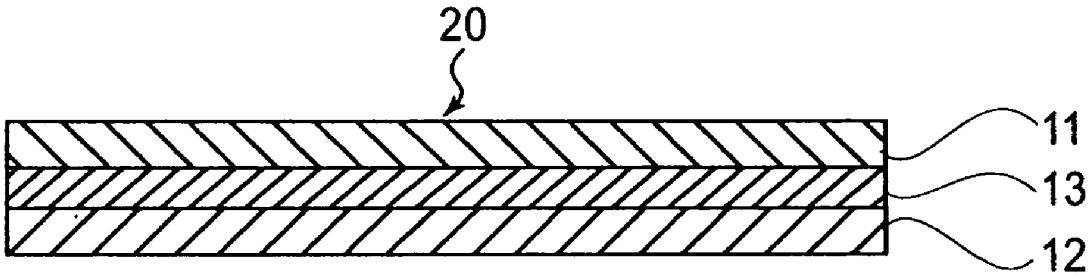
FIG. 2 is a drawing for describing the structure of the second test sample of a pad sheet in accordance with the present invention.
Figure 3:
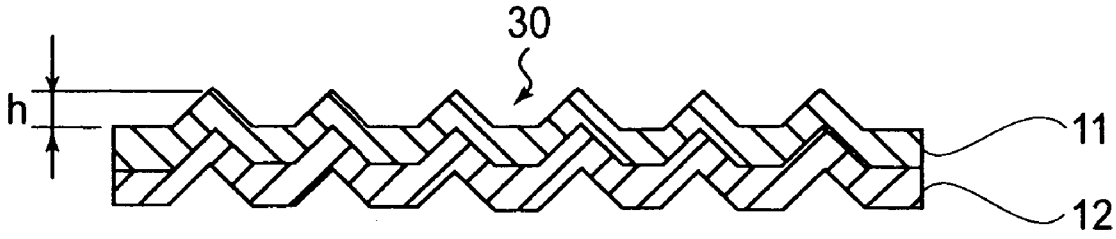
FIG. 3 is a drawing for describing the structure of the third test sample of a pad sheet in accordance with the present invention.
Figure 4:
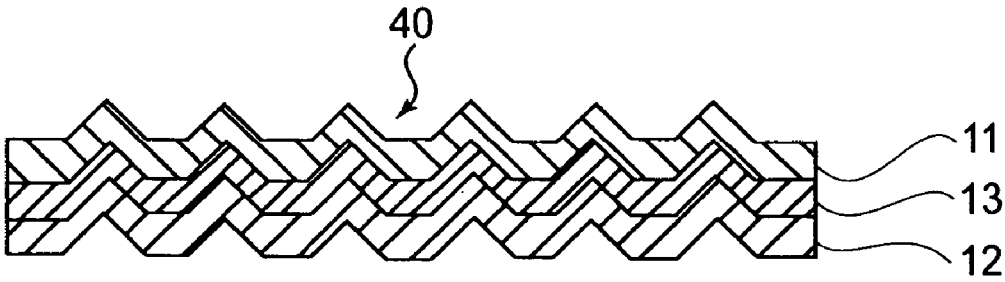
FIG. 4 is a drawing for describing the structure of the fourth test sample of a pad sheet in accordance with the present invention.

First, the test samples 1-4 of a pad sheet in accordance with the present invention will be described. FIG. 1 is a schematic drawing of a pad sheet 10, that is, the first test sample of a pad sheet in accordance with the present invention, and FIG. 2 is a schematic drawing of a pad sheet 20, that is, the second test sample of a pad sheet in accordance with the present invention. FIG. 3 is a schematic drawing of a pad sheet 30, that is, the third test sample of a pad sheet in accordance with the present invention, and FIG. 4 is a schematic drawing of a pad sheet 40, that is, the fourth test sample of a pad sheet in accordance with the present invention. Regarding the referential symbols in FIGS. 1-4, if a layer of the pad sheet in one of the drawings is the same in material as a layer of the pad sheet in another drawing, the two layers are given the same referential symbol and the same hatching, for the sake of convenience.

To begin with, the pad sheet 10, that is, the first sample of a pad sheet in accordance with the present invention, will be described.

The pad sheet 10, or the first test sample of a pad sheet in accordance with the present invention, is made up of a substrate layer 12, the tensile strength of which is in the range of 300-600 MPa, and a surface layer 11 laminated on the substrate layer 12 with the use of adhesive. As for the materials for the pad sheet 10, fluorinate resin and polyimide (which hereinafter may be referred to as PI) are used for the surface layer 11 and substrate layer 12, respectively.

As examples of the fluorinate resins suitable as the material for the surface layer 11, polymer of tetrafluoroethylene (PTFE), copolymer of tetrafluoroethylene and perfluoro (alkylvinylether) (PFA), copolymer of tetrafluoroethylene-hexafluoropropylene (FEP), polyethylene-tetrafluoroethylene (ETFE), etc., can be used. In this embodiment, a sheet of PTFE (50 μm in thickness) was used.

As the material for the substrate layer 12, it is desired to use one of the heat resistant synthetic resins. For example, polyimide (PI), polybenzimidazole (PBI), polybenzoxazole (PBO), polyamide-imide (PAI), Peek, etc are usable. In this embodiment, polyimide resin (75 μm in thickness) was used.

Next, referring to FIG. 11, the process for bonding the surface layer 11 and substrate layer 12 to each other will be described in detail.

A component (sheet) made of fluorinated resin is difficult to bond in its original state. Therefore, it is desired to be etched across the bonding surface. As the method for etching a component (sheet) made of fluorinated resin, a method similar to an ordinary method for etching PTFE sheet, for example, chemical etching, plasma etching, or the like may be employed.

In this embodiment, the substrate layer 12, that is, a sheet of fluorinate substance (PTFE in this sample), is treated with roughly 1% liquid ammonium solution of metallic sodium, across the surface to which the surface layer 11 is to be bonded (S11).

The etched sheet of fluorinated substance and a sheet of heat resistant synthetic resin (which in this sample is polyimide) are bonded to each other with the use of adhesive (S12). As the adhesive therefor, epoxy adhesive, silicon adhesive, or the like may be used.

Figure 12:
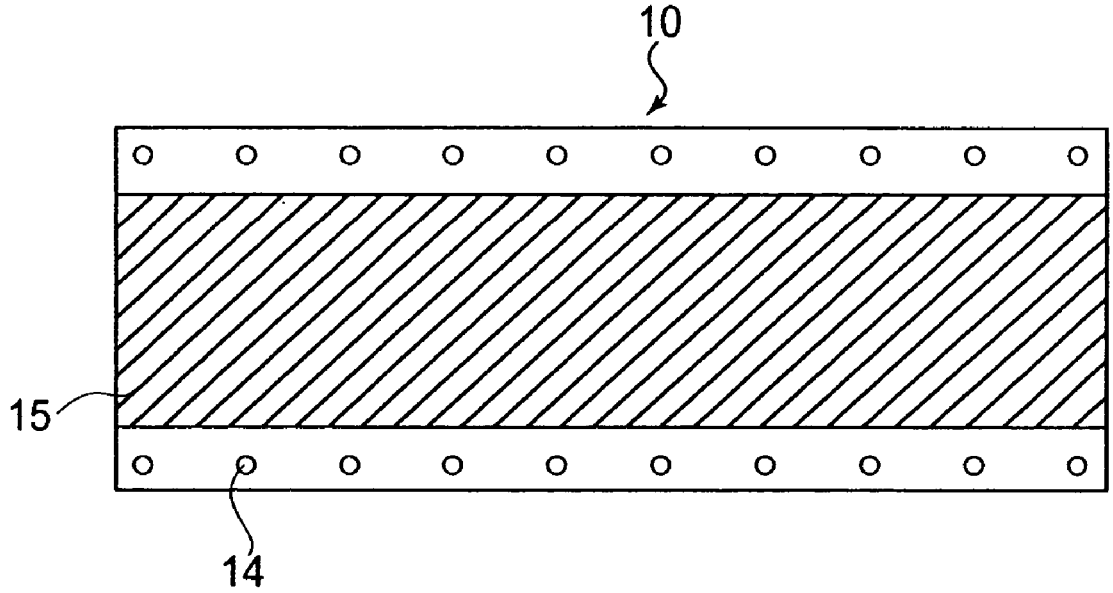
FIG. 12 is a drawing for describing the structure of the pad sheet in accordance with the present invention.

Next, the resultant laminar sheet is cut into rectangular pieces (pad sheets), and holes 14 for attaching the pad sheet to the belt pressing pad 4 are formed through each pad sheet (S13), yielding thereby pad sheets 10 such as the one shown in FIG. 12.

Figure 14:
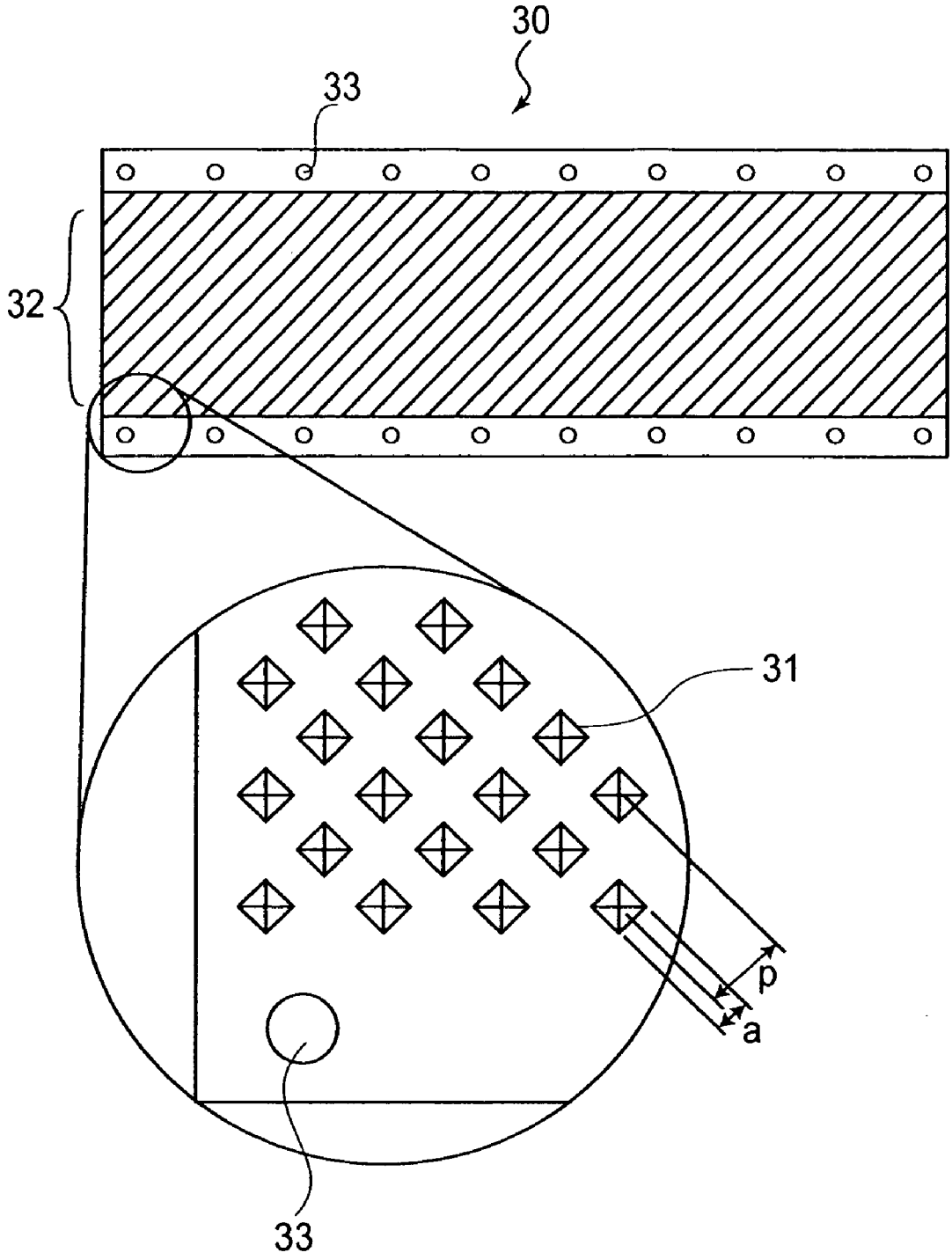
FIG. 14 is a drawing for describing the structure and arrangement of the knurls.

Referring to FIG. 12, the pad sheet attachment holes 14 on the top side will be on the upstream side in terms of the recording medium conveyance direction (moving direction of endless belt 3), and the holes 14 on the bottom side will be on the downstream side. Referring to FIG. 14, the horizontal direction will be roughly perpendicular to the recording medium conveyance direction, and the hatched area 15 is the area by which the pad sheet 10 contacts the endless belt 3; it is the area on which the endless belt 3 slides. Next, referring to FIG. 10, the pad sheet 10 is attached to the belt pressing pad 4 by putting the pad sheet attachment projections 43 into the pad sheet attachment holes 14 of the pad sheet 10, one for one.

Next, the pad sheet 30, that is, the test third sample of a pad sheet in accordance with the present invention, will be described.

The pad sheet 30, or the third test sample of a pad sheet in accordance with the present invention, is similar to the pad sheet 10, that is, the first test sample of a pad sheet in accordance with the present invention, except that the pad sheet 30 has been processed (secondary process) for knurling the pad sheet 30 across the surface which is to face the endless belt 3 (S14 in FIG. 14).

Figure 13:
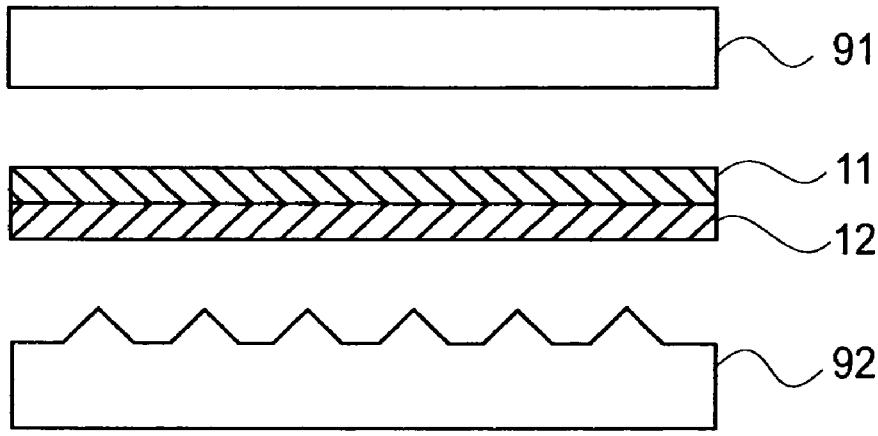
FIG. 13 is a drawing for describing the pad sheet manufacturing step for knurling a pad sheet.

Referring to FIG. 13, for the knurling of the pad sheet 30, which is carried out as the secondary processing of the pad sheet 30, a pair of molds 91 and 92 is used. The mold 91 is the top mold and is formed of an elastic substance. The mold 92 is the bottom mold, and is formed of a metallic substance.

The bottom mold 92 is provided with multiple knurls arranged in a predetermined pattern. As for the method for knurling the pad sheet 10 (3) after the bonding process, the pad sheet 10 (30) is inserted between the top and bottom molds 91 and 92, and then, the pad sheet 10 (30) is pressed by the top and bottom molds 91 and 92 while being heated.

FIG. 14 is a drawing of the finished pad sheet 30, that is, the third test sample of a pad sheet in accordance with the present invention. As shown in FIG. 14, the multiple knurls 31 on the surface of the pad sheet 30, which will be placed in contact with the endless belt 3, are in the form of a pyramid (roughly in the form of a right pyramid), the bottom edges a of which are 500 μm in length. Each of these pyramidal knurls 31 is 200 μm in height (height h from the surface of pad sheet 10, shown in FIG. 3, which hereinafter may be referred to as knurl height), and the pitch p of these knurls 31 is 1 mm. These knurls 31 are on the hatched area 32 in FIG. 14; the area 32 is the knurled area. The pad sheet 30, shown in FIG. 14, is also provided with multiple pad sheet attachment holes 33 like the pad sheet attachment holes 14 of the pad sheet 10 shown in FIG. 12.

Failing to apply a sufficient amount of heat to a precursor (pad sheet 10) of the pad sheet 30 results in the formation of a pad sheet 30 with knurls with an insufficient height. When a pad sheet 30, the knurls of which are no higher than 100 μm, was tested for durability (fixing apparatus was assembled using pad sheet 30), its knurls collapsed. Thus, the requirement that the knurl height must be no less than 100 μm was specified. The upper limit for the knurl height was set to 300 μm, since there was little problem as long as the knurl height was on the higher side. However, when the thickness of the substrate layer formed of polyimide was no less than 300 μm, a pad sheet, the knurls of which were no more than 100 μm in height, was yielded.

Therefore, the thickness of the substrate layer is desired to be set to a value no less than 75 μm and no more than 300 μm.

The knurls 31 formed on the pad sheet 30 are for reducing the overall contact area between the pad sheet 30 and endless belt 3. Thus, the shape of each knurl does not need to be limited to the above described one. For example, each knurl may be in the form of a trigonal pyramid, or a cone. Further, the knurls 31 do not need to be diagonally arranged at 45° as shown in FIG. 14.

Next, pad sheets 20 and 40, that is, second and fourth test samples of a pad sheet in accordance with the present invention, will be described.

The pad sheets 20 and 40, that is, the second (FIG. 2) and fourth (FIG. 4) test samples of a pad sheet in accordance with the present invention, are provided with a middle layer 13, which is disposed between the surface layer 11 and substrate layer 12 to prevent a pad sheet from curling. The pad sheets 20 and 40, that is, the second (FIG. 2) and fourth (FIG. 4) test samples of a pad sheet in accordance with the present invention, are the same in the surface and substrate layers as the pad sheets 10 and 30, that is, the fist and third test samples of a pad sheet in accordance with the present invention.

The pad sheets 10 and 30, that is, the first and third test samples of a pad sheet in accordance with the present invention, which do not have the middle layer 13, may possibly curl, because they are made by bonding two layers different in coefficient of thermal expansion to each other. One of the methods for preventing a pad sheet constructed like the pad sheets 10 and 30 from curling is to provide the pad sheet with a curl prevention layer as a middle layer. The pad sheets 20 and 40, that is, the second and fourth test samples of a pad sheet in accordance with the present invention, are the combination of the pad sheets 10 and a curl prevention middle layer, and the combination of the pad sheet 30 and a curl prevention middle layer, respectively.

As the material for the middle layer 13, rubbery substances such as silicon rubber, fluorinated rubber, nitrile rubber, urethane rubber, or the like can be used. In this embodiment, a sheet of a rubbery substance with a thickness of 25 μm was used as the material for the middle layer 13.

Figure 15:
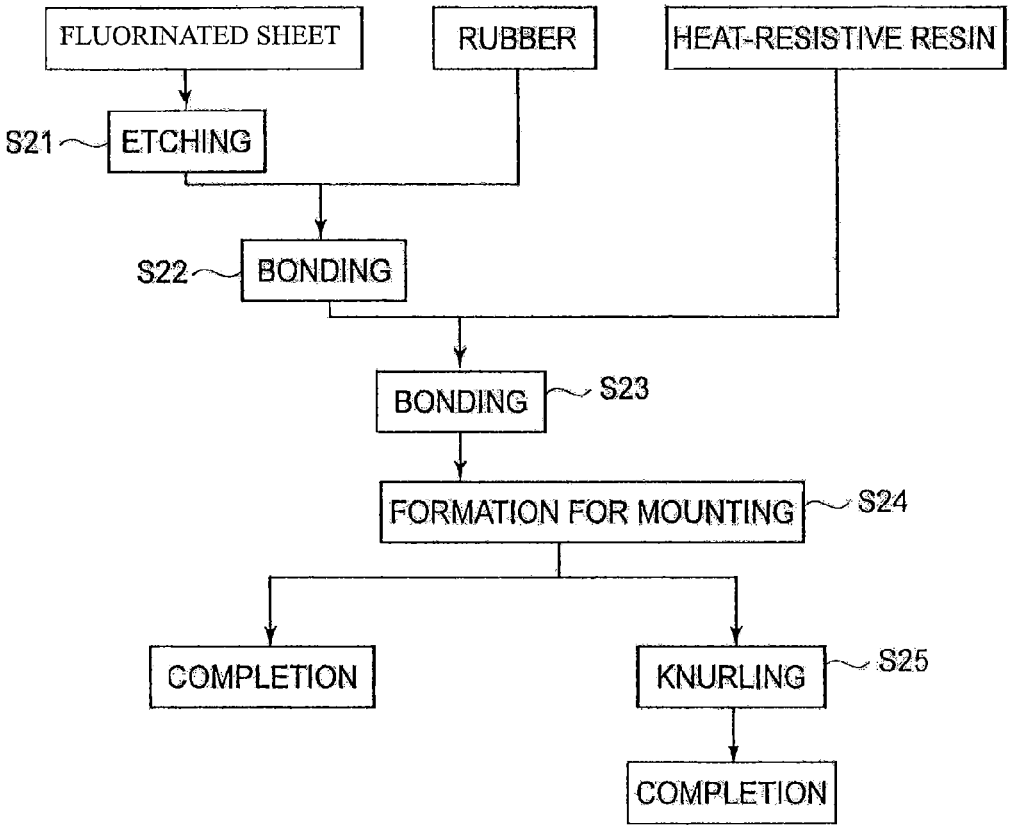
FIG. 15 is a diagrammatic drawing for describing the process for manufacturing the second and fourth test samples of a pad sheet in accordance with the present invention.

Next, the process for manufacturing the second and fourth test samples of a pad sheet in accordance with the present invention will be described, with reference to FIG. 15, which is a diagrammatic drawing showing the process for manufacturing the second and fourth test samples of a pad sheet.

First, a sheet of fluorinated substance, as the material for the surface layer 11, is etched (S21), and a sheet of rubbery substance, as the material for the middle layer 13, is bonded to the etched sheet of fluorinated substance (S22). Then, the bonded combination of the sheet of fluorinated substance and sheet of rubbery substance is bonded to a sheet as the material for the substrate layer 12 (S23). Then, the resultant laminar sheet with three layers is processed to yield pad sheets 20, which are rectangular pad sheets with attachment holes (S24, which is similar to S13 in FIG. 11). As for the process for manufacturing the pad sheet 40, the pad sheet 20 is subjected to the same knurling process as that carried out in S14 in FIG. 11 (S25).

Figure 5:
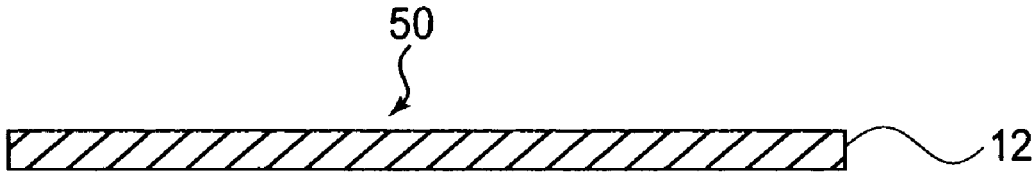
FIG. 5 is a drawing for describing the first comparative pad sheet.
Figure 6:
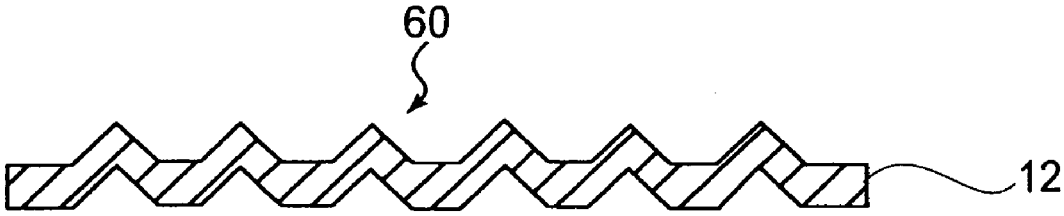
FIG. 6 is a drawing for describing the second comparative pad sheet.
Figure 7:
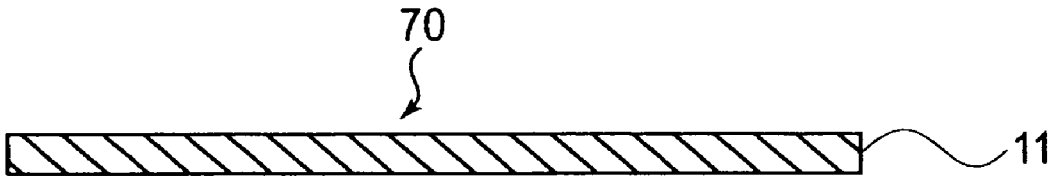
FIG. 7 is a drawing for describing the third comparative pad sheet.
Figure 8:
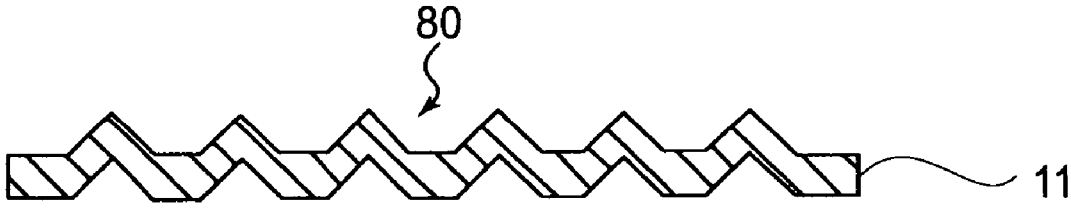
FIG. 8 is a drawing for describing the fourth comparative pad sheet.

Next, the comparative samples of a pad sheet will be described. FIG. 5 is a drawing of a pad sheet 50, which is the first comparative pad sheet, and FIG. 6 is a drawing of a pad sheet 60, which is the second comparative a pad sheet. FIG. 7 is a drawing of a pad sheet 70, which is the third comparative a pad sheet, and FIG. 8 is a drawing of a pad sheet 80, which is the fourth comparative a pad sheet. Incidentally, if any of the layers of the first to fourth comparative pad sheet, shown in FIGS. 5-8, is formed of the same material as that of one of the layers of the first to fourth test samples of a pad sheet in accordance with the present invention, the two layers are given the same referential symbol, and the same hatching.

Figure 11:
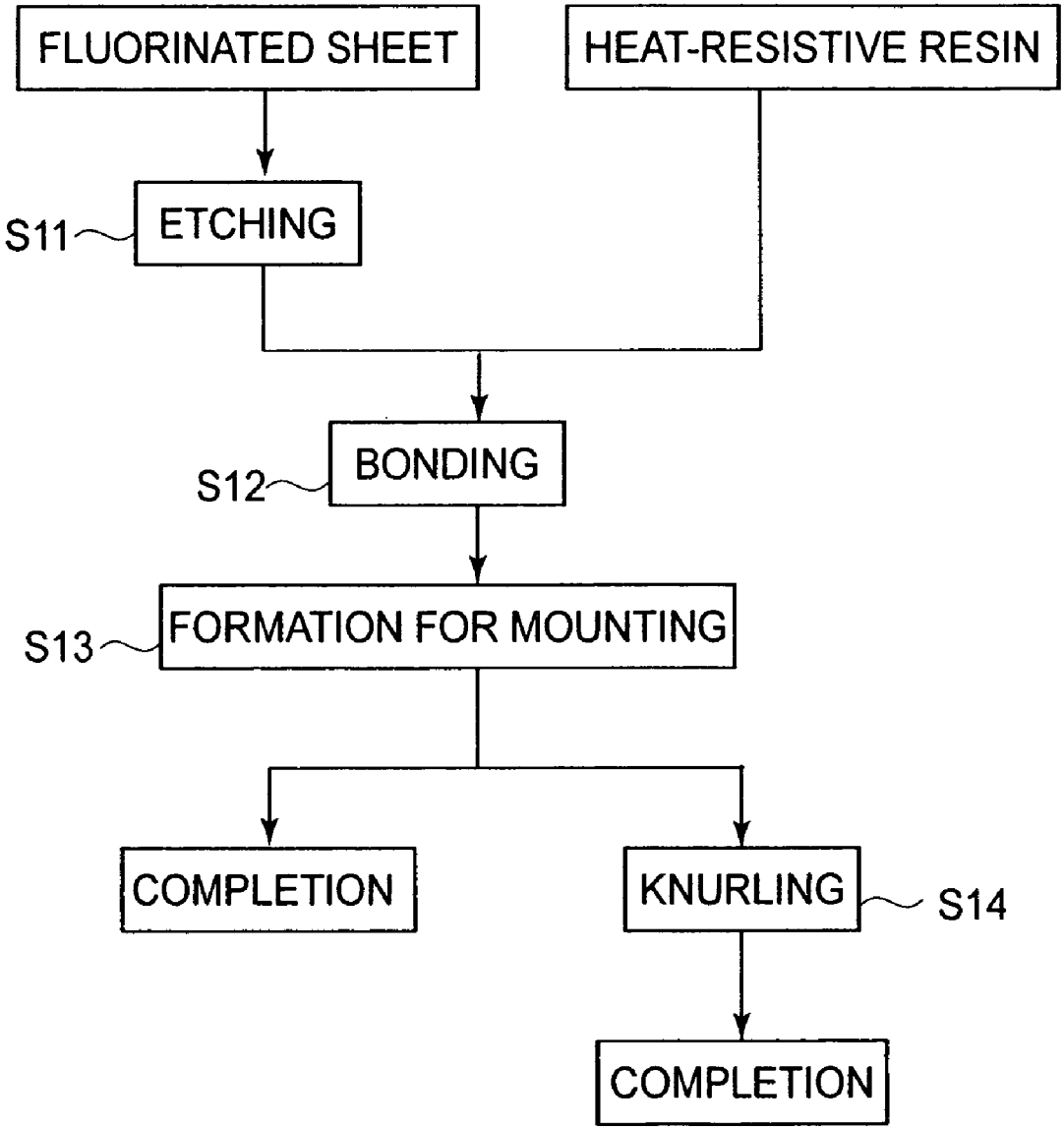
FIG. 11 is a diagrammatic drawing for describing the process for manufacturing the first and third test samples of a pad sheet in accordance with the present invention.

The pad sheet 50 (first comparative pad sheet), shown in FIG. 5, is formed by subjecting a 75 μm thick sheet of polyimide alone, to the process for forming the attachment holes (same process as that carried out in S13 in FIG. 11).

The pad sheet 60 (second comparative pad sheet), shown in FIG. 6, is formed by subjecting the pad sheet 50 (first comparative pad sheet) to the same knurling process as that carried out in S14 in FIG. 11.

The pad sheet 70 (third comparative pad sheet), shown in FIG. 7, is formed by subjecting a 150 μm thick sheet of PTFE to the process for forming the attachment holes (same process as that carried out in S13 in FIG. 11).

The pad sheet 80 (fourth comparative pad sheet), shown in FIG. 8, is formed by subjecting the pad sheet 70 to the same knurling process as that carried out in S14 in FIG. 11.

The first to fourth test samples of a pad sheet in accordance with the present invention and first to fourth comparative pad sheets were compared in torque, shudders, and durability, by mounting them in the fixing apparatus 1. The results are given in the following Table 2.

TABLE 2

| | layer structure | knurling | torque | shuddering | durability |
|---|---|---|---|---|---|
| Exp. 1 | fluorinate resin + PI | No | G | G | G |
| Exp. 2 | fluorinate resin + rubber layer + PI | No | G | G | G |
| Exp. 3 | fluorinate resin + PI | Yes | E | G | G |
| Exp. 4 | fluorinate resin + rubber layer + PI | Yes | E | G | G |
| Comp. 1 | PI single layer | No | N | — | — |
| Comp. 2 | PI single layer | Yes | F | N | G |
| Comp. 3 | single layer of fluorinate resin | No | G | G | N |
| Comp. 4 | single layer of fluorinate resin | Yes | E | G | N |

Torque
E: no problem
G: practically no problem
F: slightly higher
N: roller is not rotatable
Shuddering
G: none
N: occurred
Durability
G: no problem
N: deformation occurred The torque in the table means the measured amount of torque necessary to rotate the thermal fixation roller 2. The major portion of the torque necessary to rotate the thermal fixation roller 2 is attributable to the friction between the endless belt 3 and pad sheet, more specifically, the type of the pad sheet. The smaller the amount of the torque necessary to rotate the thermal fixation roller 2, the better. That is, the greater the amount of the torque necessary to rotate the thermal fixation roller 2, the faster the endless belt wears, and therefore, the less durable the fixing apparatus. If the amount of the torque necessary to rotate the thermal fixation roller 2 is as high as that necessary to rotate the fixation roller of the fixing apparatus employing the first comparative pad sheet 50, the fixation roller 2 cannot be rotated. Further, the presence of a fluorinated surface layer seems to reduce the amount of the torque necessary to rotate the fixation roller 2, and as does the presence of the knurls.

The shudders which occur when the fixation roller 2 is rotated at a slower peripheral velocity, for example, when thick medium such as cardboard is conveyed through the fixing apparatus, are attributable to the stick-and-slip phenomenon that is caused by the friction between the endless belt and pad sheet. Here, the shudders were studied by driving the fixing apparatus 1 at a process speed of 100 mm/sec, which is half the normal processing speed at which ordinary recording sheets are conveyed through the fixing apparatus 1. The employment of the comparative pad sheets 50 and 60, which are high in the amount of the torque necessary to drive the fixation roller 2, resulted in the occurrence of the shudders. But, the employment of the first to fourth test samples of a pad sheet in accordance with the present invention did not cause the shudders.

The durability of the pad sheets was tested by idling the fixing apparatus (rotating fixation roller without conveying recording medium) for 100 hours, while keeping the surface temperature of the thermal fixation roller 2 at 170°. The results were: In the case of the first and fourth test samples of a pad sheet in accordance with the present invention, and the second comparative pad sheet 60, the amount of the torque necessary to rotate the thermal fixation roller did not increase in proportion to the cumulative length of usage, and the knurls did not collapse. In the case of the third comparative pad sheet 70, the fluorinated sheet stretched, although the amount of the torque necessary for rotating the thermal fixation roller 2 did not increase. In the case of the fourth comparative pad sheet 80, the amount of the torque slightly increased, and the knurls collapsed to a height of no more than 50 μm.

As described above, the first to fourth test samples of a pad sheet in accordance with the present invention were relatively low in the amount of the torque necessary to rotate the thermal fixation roller 2, virtually free of the shudders, and satisfactorily durable. However, the first to fourth comparative pad sheets were unsatisfactory in performance, that is, in terms of the torque, shudders, and durability.

The first to fourth test samples of a pad sheet in accordance with the present invention, and the first to fourth comparative pad sheets, were also tested for coefficient of friction and tensile strength.

As for the coefficient of friction, the coefficient of static friction of the inward surface of each endless belt, and the coefficient of static friction of the surface of each pad sheet, were measured with the use of a HEIDON muse (product of Shinto Chemical, Co., Ltd.). As for their tensile strengths, they were measured with use of a Tension (produce of Orientech, Co., Ltd.), while pulling 5 mm wide piece of each pad sheet at a speed of 100 mm/min.

The measured coefficient of static frictions and tensile strengths of these pad sheets are given in the following Table 3.

TABLE 3

| | layer structure | knurling | static friction coefficient (relative to Belt inside) inside) | tensile strength [Mpa] |
|---|---|---|---|---|
| Exp. 1 | fluorine resin + PI | No | 0.18-0.20 | 300-600 |
| Exp. 2 | fluorine resin + rubber layer + PI | No | 0.18-0.20 | 300-600 |
| Exp. 3 | fluorine resin + PI | Yes | 0.15-0.18 | 300-600 |
| Exp. 4 | fluorine resin + rubber layer + PI | Yes | 0.15-0.18 | 300-600 |
| Comp. 1 | PI single layer | No | 0.5-0.6 | 300-600 |
| Comp. 2 | PI single layer | Yes | 0.23-0.25 | 300-600 |
| Comp. 3 | single layer of fluorine resin | No | 0.18-0.20 | 15-40 |
| Comp. 4 | single layer of fluorine resin | Yes | 0.15-0.18 | 15-40 |

As will be evident from the results of the measurement given in Table 3, as far as the coefficient of static friction is concerned, the pad sheets formed of fluorinated resin alone, or having a surface layer formed of fluorinated resin, were lower than the pad sheets having no layer formed of fluorinated resin, and the pad sheets with the knurls were lower than those without the knurls. As for the tensile strength, the pad sheets having a PI layer are roughly ten times stronger than those formed of single layer sheet of fluorinated resin.

As described above, the employment of one of the laminar pad sheets made up of the low friction surface layer 11, and the substrate layer 12, the tensile strength of which is in the range of 300-600 MPa, can prevent the pad sheet from being deformed (for example, stretched) by the friction between the pad sheet and the inward surface (reverse side) of the endless belt 3.

Further, even if the surface layer 11 and substrate layer 12 of a pad sheet are different in coefficient of thermal expansion, placing the middle layer 13 between the surface layer 11 and substrate layer 12 of the pad sheet can prevent the pad sheet from curling after the pad sheet is thermally processed.

Further, knurling a pad sheet can further reduce the friction between the pad sheet and the inward surface of the endless belt.

The height of each knurl formed on the surface of a pad sheet is desired to be in the range of 100 μm-300 μm. With a pad sheet knurled across the surface which is to be placed in contact with the inward surface of the endless belt, the lubricant such as oil coated on the inward surface of the endless belt to reduce the friction between a pad sheet and endless belt will be retained in the intervals among the knurls, more effectively reducing the friction between the pad sheet and endless belt.

In other words, the present invention can keep the friction between the endless belt 3 and any of the pad sheets 10, 20, 30, and 40, which cover the endless belt pressing pad 4, at a low level for a long time, being therefore capable of preventing such problems that a recording medium becomes misaligned with the toner image thereon because of the friction between the pad sheet and endless belt; a recording medium is unsatisfactorily conveyed because of the friction; shudders occur because of the friction when the thermal fixation roller is rotated at a low peripheral velocity.

The above described structural arrangement for an image fixing apparatus can keep the friction between the fixation belt and pad sheet at a low level for a long time. In other words, the present invention can provide a technology that can prevent the problems that a recording medium becomes misaligned with the toner image thereon because of the friction between the pad sheet and endless belt; a recording medium is unsatisfactorily conveyed because of the friction; shudders occur because of the friction when the thermal fixation roller is rotated at a low peripheral velocity.

While the invention has been described with reference to the structures disclosed herein, it is not confined to the details set forth, and this application is intended to cover such modifications or changes as may come within the purposes of the improvements or the scope of the following claims.

This application claims Priority from Japanese Patent Application No. 305515/2004 filed Oct. 20, 2004, which is hereby incorporated by reference.

What is claimed is:

1. An image heating apparatus comprising:

a heating rotatable member for heating an image on a recording material in a heating nip;

a belt cooperating with said heating rotatable member to form the heating nip;

a pad for pressing said belt toward said heating rotatable member at the heating nip; and a pad covering sheet covering a surface of said pad opposed to said heating rotatable member, wherein said pad covering sheet includes a surface resin layer having a low friction property, a base resin layer having a tensile strength of 300-600 MPa, and a rubber layer between said surface resin layer and said base resin layer.

2. An apparatus according to claim 1, wherein said base resin layer has a thickness of not less than 75 μm and not more than 300 μm.

3. An apparatus according to claim 1, wherein a friction coefficient of said surface resin layer relative to said belt is 0.15-0.18.

4. An apparatus according to claim 1, wherein said surface resin layer has pits and projections.

5. An apparatus according to claim 4, wherein the pits of said surface resin layer have a height of 100-300 μm.

6. An apparatus according to claim 1, wherein said base resin layer comprises polyimide resin material.

7. An apparatus according to claim 1, wherein said surface resin layer comprises fluorinated resin material.

8. An apparatus according to claim 1, wherein said apparatus fixes an unfixed image on the recording material in the heating nip.

9. A pad covering sheet for an image heating apparatus, the image heating apparatus including a heating rotatable member for heating an image on a recording material in a heating nip; a belt for cooperating with said heating rotatable member to form the heating nip; and a pad for pressing said belt toward said heating rotatable member at the heating nip; said pad covering sheet covering a surface of said pad opposed to said heating rotatable member, said pad covering sheet comprising:

a surface resin layer having a low friction property;

a base resin layer having a tensile strength of 300-600 MPa; and a rubber layer between said surface resin layer and said based resin layer.

* * * * *

UNITED STATES PATENT AND TRADEMARK OFFICE

CERTIFICATE OF CORRECTION

PATENT NO. : 7,379,697 B2
APPLICATION NO. : 11/252732
DATED : May 27, 2008
INVENTOR(S) : Yoshikuni Ito et al.

It is certified that error appears in the above-identified patent and that said Letters Patent is hereby corrected as shown below:

ON THE TITLE PAGE
At Item (57), Abstract,
line 8, “wherein includes” should read --wherein the pad covering the sheet includes--.
Line 9, “base” should read --base resin--.

COLUMN 1
Line 18, “facsimileing” should read --facsimile--.
Line 22, “facsimileing” should read --facsimile--.

COLUMN 2
Line 4, “above described” should read --above-described--.
Line 10, “is” (second occurrence) should be deleted.
Line 17, “above described” should read --above-described--.
Line 20, “above described” should read --above-described--.
Line 30, “above described” should read --above-described--.
Line 35, “arises” should read --arise--.
Line 42, “above described” should read --above-described--.
Line 46, “above described” should read --above-described--.
Line 50, “occur” should read --occurs--.
Line 62, “above described” should read --above-described--.

COLUMN 3
Line 5, “wherein includes” should read --the pad covering the sheet--.

COLUMN 4
Line 10, “facsimileing” should read --facsimile--.
Line 59, “though” should read --through--; and “above” should read --above- --.
Line 60, “developer” should read --developed--.

COLUMN 8
Line 13, “Peek etc” should read --Peek, etc.,--.

COLUMN 9
Line 3, “sheet 10 (3)” should read --sheet 10 (30)--.
Line 41, “above described” should read --above-described--.
Line 56, “fist” should read --first--.

UNITED STATES PATENT AND TRADEMARK OFFICE

CERTIFICATE OF CORRECTION

PATENT NO. : 7,379,697 B2
APPLICATION NO. : 11/252732
DATED : May 27, 2008
INVENTOR(S) : Yoshikuni Ito et al.

It is certified that error appears in the above-identified patent and that said Letters Patent is hereby corrected as shown below:

COLUMN 10
Line 35, “a” should be deleted.
Line 37, “a” (first occurrence) should be deleted.
Line 38, “a” should be deleted.

COLUMN 12
Line 25, “(produce” should read --(product--.
Line 38, (Table 3), “inside)”, should be deleted.

COLUMN 13
Line 29, “above described” should read --above-described--.

COLUMN 14
Line 46, “based” should read --base--.

Signed and Sealed this

Seventeenth Day of February, 2009

JOHN DOLL
*Acting Director of the United States Patent and Trademark Office*